United States Patent [19]

Shu

[11] 4,454,916

[45] Jun. 19, 1984

[54] IN-SITU COMBUSTION METHOD FOR RECOVERY OF OIL AND COMBUSTIBLE GAS

[75] Inventor: Winston R. Shu, Dallas, Tex.

[73] Assignee: Mobil Oil Corporation, New York, N.Y.

[21] Appl. No.: 445,118

[22] Filed: Nov. 29, 1982

[51] Int. Cl.[3] ..... E21B 43/243; E21B 43/34

[52] U.S. Cl. ..... 166/260; 166/267; 299/2

[58] Field of Search ..... 166/256, 259, 260, 266, 166/267; 299/2, 11

[56] References Cited

U.S. PATENT DOCUMENTS

| | | | |
|---|---|---|---|
| 2,722,277 | 11/1955 | Crawford | 166/260 |
| 3,035,638 | 5/1962 | Parker et al. | 166/260 |
| 3,126,954 | 3/1964 | Campion | 166/260 |
| 3,126,955 | 3/1964 | Trantham et al. | 166/256 |
| 3,221,812 | 12/1965 | Prats | 166/260 |
| 3,794,116 | 2/1974 | Higgins | 166/259 |
| 4,014,575 | 3/1977 | French et al. | 166/256 |
| 4,086,960 | 5/1978 | Haynes | 166/260 |
| 4,158,467 | 6/1979 | Larson et al. | 166/267 |
| 4,263,970 | 4/1981 | Cha | 166/259 |
| 4,384,614 | 5/1983 | Justheim | 299/2 |

*Primary Examiner*—Stephen J. Novosad
*Assistant Examiner*—William P. Neuder
*Attorney, Agent, or Firm*—Alexander J. McKillop; Michael G. Gilman; Lawrence O. Miller

[57] ABSTRACT

A method for recovering oil by injecting an oxygen-containing gas containing at least 50 vol. % oxygen into the formation to initiate an in-situ combustion operation, separately producing oil and a flue gas from the formation, and separating carbon dioxide from the flue gas to produce a combustible gas.

2 Claims, 2 Drawing Figures

IN-SITU COMBUSTION METHOD FOR RECOVERY OF OIL AND COMBUSTIBLE GAS

FIELD OF THE INVENTION

This invention relates to an improved method for the production of oil from a subterranean formation by the procedure involving in-situ combustion. More particularly, the method involves an in-situ combustion operation for the recovery of oil and also for the purpose of producing a flue gas having a sufficient heating value to be used as a fuel.

BACKGROUND OF THE INVENTION

A variety of supplemental recovery techniques have been employed to increase the recovery of oil from subterranean formations. These techniques include thermal recovery methods, waterflooding and miscible flooding. The thermal recovery methods generally include steam injection, hot water injection and in-situ combustion.

Of the thermal recovery methods, in-situ combustion is showing increasing promise. In an in-situ combustion process, it normally involves injecting air under pressure into the oil-containing formation via an injection well to burn part of the formation oil and establish a combustion front that drives the rest of the oil which has been mobilized from the heat generated toward a spaced apart production well from which oil is recovered. Combustion or flue gases are produced along with the oil at the production well. These flue gases are not flammable due to their low heating value. A typical flue gas produced from an air driven in-situ combustion operation is about 18 BTU/SCF which is not flammable in air. The general practice is to add methane to the flue gas to raise its heating value and thus incinerate the resulting gas mixture.

A recent trend in in-situ combustion technology is to inject enriched air or pure oxygen instead of air, see U.S. Pat. No. 3,208,519 to T. V. Moore. The combustion gases from this process generally have higher heating values due to a higher carbon monoxide and methane concentration.

In the present invention, I propose an improved in-situ combustion process employing an oxygen-containing gas with a predetermined oxygen concentration to maximize the BTU value of the flue gas combined with separating carbon dioxide from the produced flue gas to further increase its heating value enabling the $CO_2$-free gas to be used as a fuel.

SUMMARY OF THE INVENTION

The present method provides a method for recovering oil from a subterranean, oil-containing formation by an in-situ combustion operation and also recovering a flue gas useful as a fuel. The subterranean, oil-containing formation is penetrated by at least one injection well and at least one spaced apart production well. Both wells are in fluid communication with a substantial portion of the vertical thickness of the oil-containing formation. An oxygen-containing gas containing at least 50 vol. % oxygen is injected into the formation via the injection well for the purpose of initiating an oxidation reaction which forms a combustion front that propagates from the injection well toward the production well. The oxidation reaction generates heat that reduces the viscosity of the oil in the formation thereby increasing its mobility and produces a flue gas containing carbon dioxide, carbon monoxide, hydrogen, and other components. Injection of the oxygen-containing gas is continued and the combustion front drives the mobilized oil and flue gas toward the production well from which they are separately produced. Carbon dioxide is separated from the flue gas to produce a gas containing sufficient fractions of carbon monoxide, hydrogen and methane to be combustible.

DESCRIPTION OF THE PREFERRED EMBODIMENTS

Briefly, this invention concerns a method for recovering oil and a flue gas from a subterranean, oil-containing formation utilizing an in-situ combustion operation in which the oxygen-containing gas injected into the formation to support combustion contains at least 50% by volume oxygen. Carbon dioxide is separated from the produced flue gas to render the gas combustible.

Figure 1:
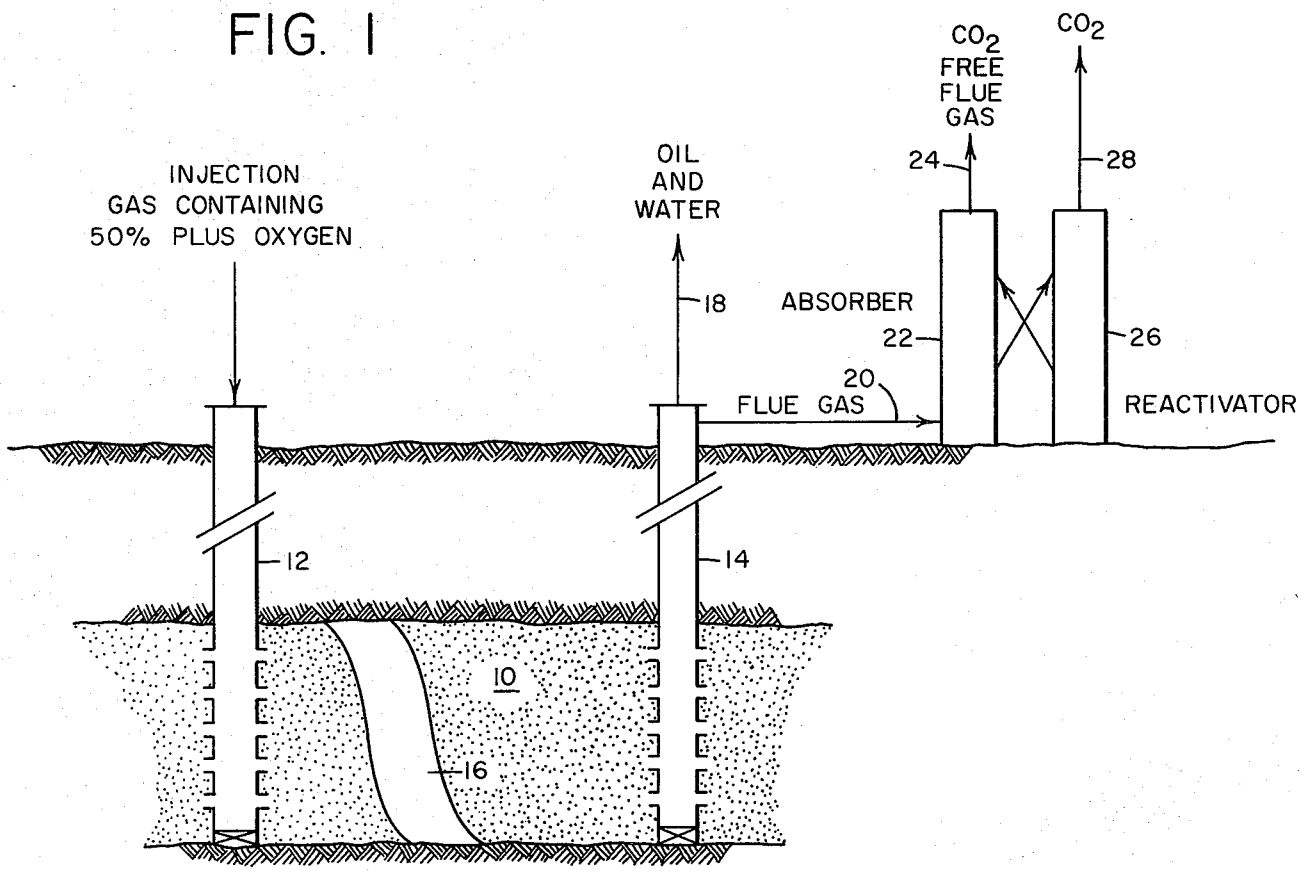
FIG. 1 schematically illustrates a method in accordance with the invention in which oil and a flue gas are recovered by an in-situ combustion operation and in which carbon dioxide is separated from the produced flue gas.

The process of my invention may be best understood by referring to the attached FIG. 1 which depicts a typical embodiment of my invention during operation. An oil-containing formation 10 is penetrated by at least one injection well 12 and at least one spaced apart production well 14, both wells being perforated to establish fluid communication with a substantial portion of the vertical thickness of the formation. An oxygen-containing gas containing at least 50% by volume oxygen is injected into the formation 10 via injection well 12 to initiate an in-situ combustion operation therein adjacent the injection well. The oxygen-containing gas is injected at a volume of about 2 to 4 MMSCF of oxygen per acre-foot of formation and a rate of about 100–300 MSCF of oxygen per day per injector. The resulting in-situ combustion front 16 is advanced through the formation 10 towards the production well 14 by continuing to inject the oxygen-containing gas. The heat generated by in-situ combustion lowers the viscosity of the formation oil thereby increasing the mobility of the oil making it easier for the combustion front to drive the oil towards production well 14 for recovery. The oxidation reaction occurring in the formation 10 by the combustion procedure produces a flue gas containing various constituents including carbon dioxide, carbon monoxide, hydrogen and methane which are displaced along with the mobilized oil through the formation towards production well 14. Oil and water are produced from production well 14 through the tubing 18 of the well and passed to conveniently located storage tanks where the oil is recovered. Some gas dissolved in oil may be recovered also at this stage and may be directed back to the flue gas line. Flue gas is separately recovered from production well 14 through line 20 by pulling a vacuum on the casing of the well which causes the flue gas to be separated from the oil at the formation face and to be conducted up the casing. Carbon dioxide is separated from the flue gas by directing the flue gas to a carbon dioxide absorber 22 in which the flue gas countercurrently flows against a scrubber liquid such as an alkali water solution or an amine. The $CO_2$-free flue gas exists from absorber 22 through line 24 and is sent to a storage system to be utilized as a fuel gas. The carbon dioxide may be recovered from the scrubber liquid by passing the scrubber liquid into a reactivator 26. The carbon dioxide is released through line 28 and may be used for well stimulation or other enhanced oil recovery processes such as $CO_2$ flooding. The removal of carbon dioxide from a gas is a simple, standard technique in the industry, see Perry et al, "Chemical Engineers' Handbook", 5th Edition, Section 14, McGraw-Hill (1973), the disclosure of which is hereby incorporated by reference.

Utilizing a laboratory combustion tube test technique, the heating value and composition of flue gases produced by injecting an oxygen-containing gas having various concentrations of oxygen were determined. These results are shown in Table 1 for an oxygen-containing injection gas consisting of air, 50 vol. % oxygen, 75 vol. % oxygen and 95 vol. % oxygen. As shown by these results, as the concentration of oxygen of the injection gas increases, the heating value of the flue gas increases, but none of the flue gases produced are flammable in air which requires a heating value of at least 150 BTU/SCF. However, removal of carbon dioxide from the flue gas produces a flue gas that is combustible for an oxygen-containing injection gas containing at least 50% oxygen.

TABLE 1

IN-SITU COMBUSTION FLUE GAS ANALYSIS

| Run No. | 1 | 2 | 3 | 4 |
|---|---|---|---|---|
| Inlet Gas | Air | 50% $O_2$ | 75% $O_2$ | 95% $O_2$ |
| Component Mol % | | | | |
| $CO_2$ | 14.26 | 39.55 | 64.12 | 78.73 |
| CO | 3.41 | 7.49 | 8.12 | 12.24 |
| $O_2$ | 0.69 | 3.85 | 0.82 | 1.03 |
| $N_2$ | 81.03 | 46.72 | 23.54 | 5.52 |
| $H_2$ | 0.06 | 0 | 0 | 0 |
| $CH_4$ | 0.39 | 0.93 | 2.07 | 1.57 |
| $C_2H_4$ | 0 | 0.05 | 0.01 | — |
| $C_2H_6$ | 0.05 | 0.28 | 0.52 | .24 |
| $C_3H_6$ | 0 | 0.01 | 0 | — |
| $C_3H_8$ | 0.10 | 0.39 | 0.55 | .36 |
| $C_4^+$ | 0 | 0.31 | 0.42 | .31 |
| Heating Value, BTU/SCF | | | | |
| As Is | 18.48 | 59.36 | 83.74 | 78.88 |
| $Co_2$-Free | 21.55 | 98 | 233.4 | 369.5 |
| Field Gas* | 50.48 | 91.36 | 115.74 | 110.88 |
| $CO_2$-Free Field Gas | 58.87 | 151.13 | 322.58 | 521.39 |

*Assumed 32 BTU/SCF (1% $C_4^+$) over the lab measurements.

Figure 2:
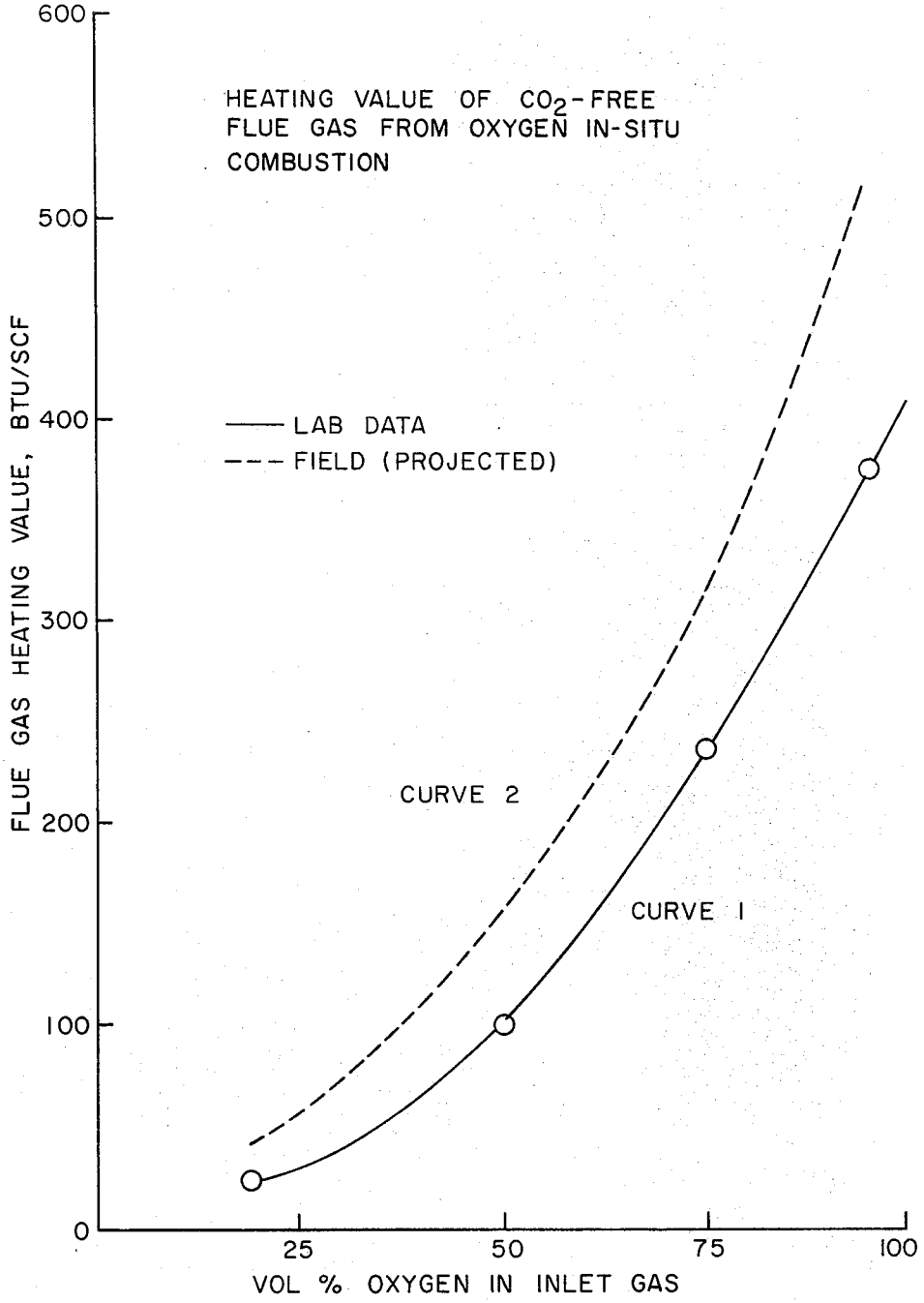
FIG. 2 shows the effect of the concentration of oxygen in the injected oxygen-containing gas on the heating value of the produced flue gas.

FIG. 2 is a graph illustrating the heating value of $CO_2$-free flue gas versus the vol. % of oxygen in the injected oxygen-containing gas. Curve 1 represents the flue gas produced from the laboratory meaasurements and curve 2 represents a predicted field gas which is assumed to have a heating value rated 32 BTU/SCF (1% C4+) more than the lab measurements. These results show that using an injected oxygen-containing gas containing at least 50 vol. % oxygen produces a $CO_2$-free flue gas containing sufficient fractions of carbon monoxide, hydrogen and methane to be combustible in air constituting a heating value of at least 150 BTU/SCF.

While the invention has been described in terms of a single injection well and a single spaced apart production well, the method according to the invention may be practiced using a variety of well patterns. Any other number of wells, which may be arranged according to any patterns, may be applied in using the present method as illustrated in U.S. Pat. No. 3,927,716 to Burdyn et al.

From the foregoing specification one skilled in the art can readily ascertain the essential features of this invention and without departing from the spirit and scope thereof can adapt it to various diverse applications. It is my intention and desire that my invention be limited only by those restrictions or limitation as contained in the claims appended immediately hereinafter below.

What is claimed is:

1. A method for the recovery of oil and a combustible gas from a subterranean, oil-containing formation penetrated by at least one injection well and by at least one spaced-apart production well, comprising:

(a) initiating an in situ combustion operation in the formation by injecting an oxygen-containing gas containing at least 50 volume percent oxygen into the injection well to establish a combustion front in said formation and produce a flue gas;

(b) continuing injection of said oxygen-containing gas to support the in-situ combustion front which heats the oil in the formation reducing its viscosity and drives the mobilized oil and flue gas through the formation toward the production well;

(c) withdrawing oil and flue gas separately from the formation via said production well; and (d) separating $CO_2$ from said flue gas to produce a combustible flue gas, having a minimum heating value of 150 BTU/SCF.

2. The method of claim 1 wherein the volume of oxygen-containing gas is injected in about 2 to 4 MMSCF of oxygen per acre-foot of formation and the oxygen injection rate is about 100 to 300 MSCF/Day per injector.

* * * * *